US009260829B1

(12) United States Patent
Maus et al.

(10) Patent No.: US 9,260,829 B1
(45) Date of Patent: Feb. 16, 2016

(54) PEDESTRIAN BARRICADE

(71) Applicant: TRAFFIX DEVICES, INC., San Clemente, CA (US)

(72) Inventors: Geoffrey B. Maus, Mission Viejo, CA (US); Felipe Almanza, Perris, CA (US); Jeremy Smith, San Clemente, CA (US); Jack H. Kulp, Dana Point, CA (US); Brent M. Kulp, San Clemente, CA (US); Clayton Herman, Fairfield, IA (US)

(73) Assignee: TRAFFIX DEVICES, INC., San Clemente, CA (US)

( * ) Notice: Subject to any disclaimer, the term of this patent is extended or adjusted under 35 U.S.C. 154(b) by 0 days.

(21) Appl. No.: 14/217,050

(22) Filed: Mar. 17, 2014

Related U.S. Application Data

(60) Provisional application No. 61/787,932, filed on Mar. 15, 2013.

(51) Int. Cl.
*E01F 13/02* (2006.01)

(52) U.S. Cl.
CPC ..... *E01F 13/022* (2013.01)

(58) Field of Classification Search
CPC ..... E01F 13/022; E01F 13/02; E01F 13/00; G09F 7/18; G09F 7/22; G09F 15/0056; G09F 15/0062; A47D 13/061; A47D 9/005
USPC ..... 404/6; 116/63 P; 40/606.01, 606.15; 256/25–26, 31
See application file for complete search history.

(56) References Cited

U.S. PATENT DOCUMENTS

| | | | | |
|---|---|---|---|---|
| 5,419,065 | A * | 5/1995 | Lin | 40/550 |
| 5,993,103 | A * | 11/1999 | Christensen | 404/6 |
| 6,190,084 | B1 * | 2/2001 | Ibanez | 404/6 |
| 6,257,559 | B1 * | 7/2001 | Mouri | 256/26 |
| 6,676,113 | B2 * | 1/2004 | Christensen et al. | 256/25 |
| 7,540,682 | B1 * | 6/2009 | Christensen et al. | 404/6 |
| D599,488 | S * | 9/2009 | Christensen et al. | D25/48.5 |
| 7,789,585 | B2 * | 9/2010 | Christensen et al. | 404/6 |
| D665,689 | S * | 8/2012 | Mettler et al. | D10/113.3 |
| 8,302,937 | B2 * | 11/2012 | Mettler et al. | 256/26 |

* cited by examiner

*Primary Examiner* — Abigail A Risic
(74) *Attorney, Agent, or Firm* — Donald E. Stout; Stout, Uxa & Buyan, LLP

(57) ABSTRACT

A pedestrian barricade segment is attachable to adjacent similar segments using a hinge construction to form a barricade of a desired configuration. A support leg is rotatable between a stowed and a deployed orientation. A recess is disposed in the segment for receiving the leg when it is stowed. A locking ramp secures the leg in the recess. A foot pocket is disposed in the rear vertical face above the recess so that a user may insert their foot into the foot pocket and use the foot to push the leg downwardly, thereby releasing the leg from the locking ramp for deploying the leg. The leg hinge structure includes a wedge and a wave washer disposed on a flat surface of the block, for securing one end of the leg. The leg hinge structure pre-loads the leg, with the wedge, creating a pivoting bushing surface for rotating the leg.

9 Claims, 5 Drawing Sheets

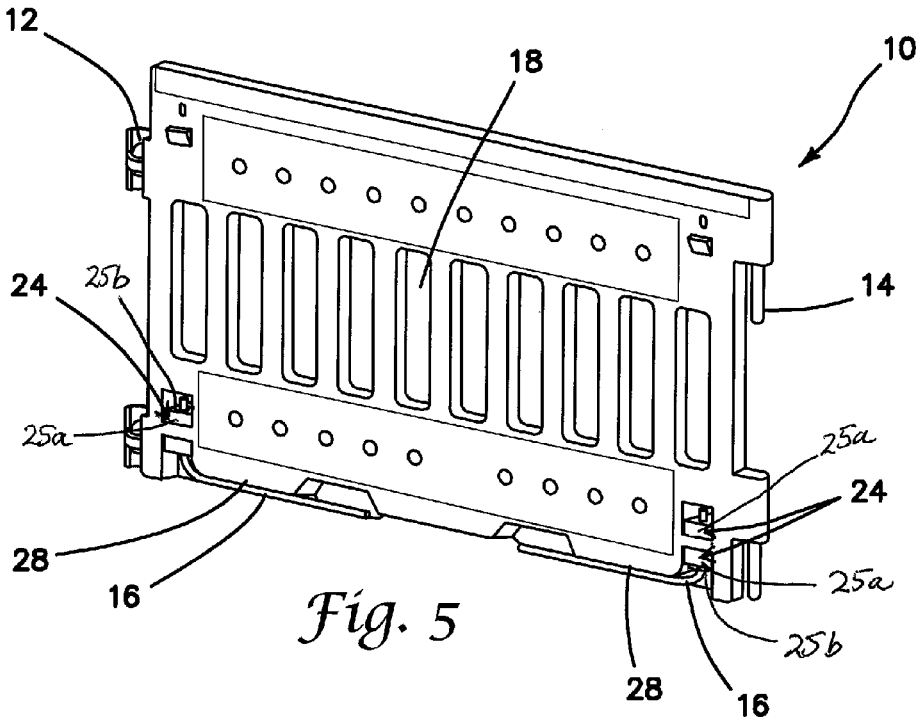
Fig. 5
Fig. 6
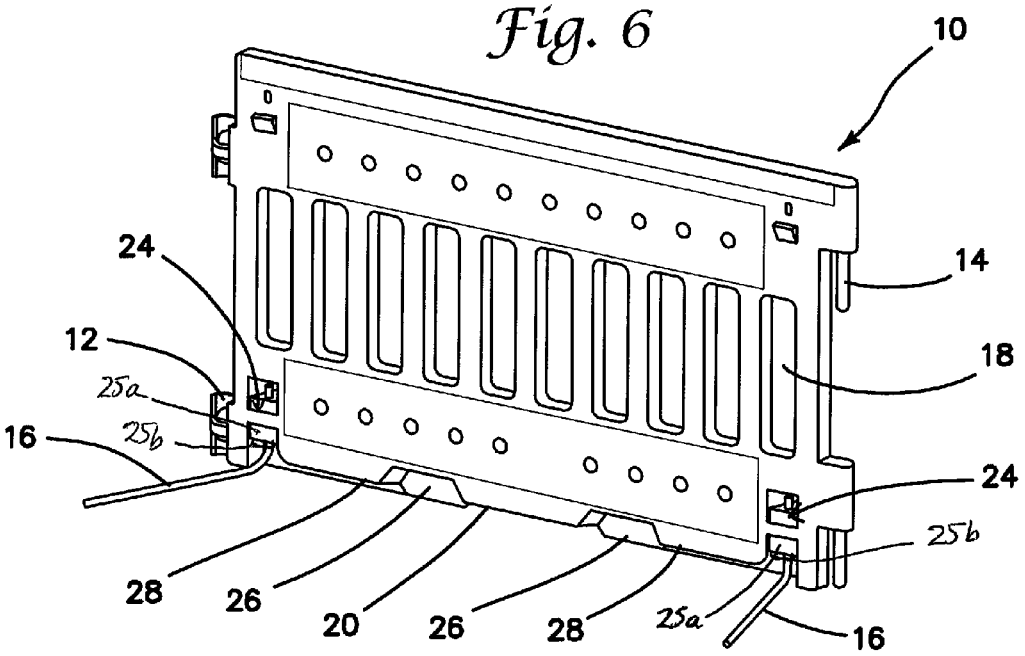

PEDESTRIAN BARRICADE

This application claims the benefit under 35 U.S.C. 119(e) of the filing date of Provisional U.S. Application Ser. No. 61/787,932, entitled Pedestrian Barricade, filed on Mar. 15, 2013. This prior provisional application is expressly incorporated herein by reference, in its entirety.

BACKGROUND OF THE INVENTION

The present invention relates to pedestrian barricades which are particularly designed to accommodate the safe transit of the disabled.

Over the years, federal and state governments have promulgated increasingly stringent safety regulations designed to ensure that the disabled are accounted for in public accommodations, thereby permitting those with disabilities to have full, substantially unrestricted, and safe access. For example, the Americans with Disabilities Act (ADA), and regulations promulgated under its authority, require that for any sidewalk closure, there needs to be an alternate accessible pedestrian route. The alternate route must be clearly marked and detectable by pedestrians with visual impairments. Thus, cones and tape, which long have been used to mark such alternate routes, are unacceptable under these types of regulations because they are not adequately detectable by the visually impaired. Accordingly, barricade systems for marking such routes have become the accepted standard in the industry.

At a minimum, such ADA-compliant barricades must typically comprise a lower cane-detectable, solid rail, beginning at its lower edge a maximum of 2.5" above grade and ending at its upper edge a minimum of 6" above grade, as well as an upper solid protective rail 36-42" above grade. The cane detectable rail must be highly visible (painted orange, white, or yellow, typically), and both rails must be continuous. The lower and upper rails must be in a common vertical plane, and no part of the barricade is permitted to protrude into the walkway.

SUMMARY OF THE INVENTION

Accordingly, there is disclosed herein a pedestrian barricade system which is inexpensive to manufacture, easy to store and transport, and capable of ready assembly in any desired configuration by laborers available on the job site. The inventive system is fully ADA-compliant, and presents a highly visible, unbroken top hand rail to passersby.

In one aspect of the invention, there is provided a pedestrian barricade segment formed of molded plastic, which comprises a first vertical side having a hinge member disposed thereon, and a second vertical side having a hinge receptacle disposed thereon, wherein the hinge receptacle is configured to receive the hinge member therein and to engage therewith, to thereby adjoin the segment to an adjacent segment of similar construction. A front vertical face extends between the first and second vertical sides, while a rear vertical face similarly extends between the first and second vertical sides. A leg, preferably L-shaped, is rotatably mounted to a leg hinge structure disposed on the rear vertical face, the leg being rotatable between a stowed orientation wherein the leg lies parallel to the rear vertical face, and a deployed orientation wherein the leg lies at an angle relative to the rear vertical face so that the leg extends rearwardly from the rear vertical face to support the barricade segment in an upright orientation. A recess is disposed in the rear vertical face for receiving the leg when it is in its stowed orientation. A locking ramp is provided for securing the leg in the recess. A foot pocket is disposed in the rear vertical face which is sufficiently large to receive the toe of a user's foot. The foot pocket is disposed above the recess so that a user may insert their foot into the foot pocket and use the foot to push the leg downwardly, thereby releasing the leg from the locking ramp for deploying the leg.

The leg hinge structure comprises a wedge having a flat surface thereon, and further comprises a wave washer disposed on the flat surface of the block, for securing one end of the leg. The leg hinge structure functions to pre-load the leg, with the wedge creating a solid pivoting bushing surface for rotating the leg. The leg hinge structure further comprises a second wedge disposed adjacent to the wedge, the second wedge also having a flat surface thereon, with the leg hinge structure also comprising a second wave washer disposed on the flat surface of the second wedge.

The barricade segment further comprises a plurality of vertically-oriented windows disposed in the segment and extending along a majority of a total height of the segment. A plurality of gaps are molded into a bottom edge of the segment, for permitting water flow beneath the segment.

A recess molded may be molded into the hinge member for strengthening its construction.

In another aspect of the invention, there is provided a pedestrian barricade segment formed of molded plastic, which comprises a first vertical side joinable to a vertical side of an adjacent barricade segment and a second vertical side joinable to a vertical side of an adjacent barricade segment. A front vertical face extends between the first and second vertical sides, while a rear vertical face similarly extends between the first and second vertical sides. A leg, preferably L-shaped, is rotatably mounted to a leg hinge structure disposed on the rear vertical face, the leg being rotatable between a stowed orientation wherein the leg lies parallel to the rear vertical face, and a deployed orientation wherein the leg lies at an angle relative to the rear vertical face so that the leg extends rearwardly from the rear vertical face to support the barricade segment in an upright orientation. A recess is disposed in the rear vertical face for receiving the leg when it is in its stowed orientation. A locking ramp is provided for securing the leg in the recess. A foot pocket is disposed in the rear vertical face which is sufficiently large to receive the toe of a user's foot. The foot pocket is disposed above the recess so that a user may insert their foot into the foot pocket and use the foot to push the leg downwardly, thereby releasing the leg from the locking ramp for deploying the leg.

The leg hinge structure comprises a wedge having a flat surface thereon, and further comprises a wave washer disposed on the flat surface of the block, for securing one end of the leg. The leg hinge structure functions to pre-load the leg, with the wedge creating a solid pivoting bushing surface for rotating the leg. The leg hinge structure further comprises a second wedge disposed adjacent to the wedge, the second wedge also having a flat surface thereon, with the leg hinge structure also comprising a second wave washer disposed on the flat surface of the second wedge.

The barricade segment further comprises a plurality of vertically-oriented windows disposed in the segment and extending along a majority of a total height of the segment. A plurality of gaps are molded into a bottom edge of the segment, for permitting water flow beneath the segment.

The invention, together with additional features and advantages thereof, may best be understood by reference to the following description taken in conjunction with the accompanying illustrative drawing.

BRIEF DESCRIPTION OF THE DRAWINGS

FIG. 5 is an isometric view of the barrier shown in FIG. 4;

FIG. 6 is an isometric view similar to FIG. 5, with the supporting legs extended into their deployed orientation;

DESCRIPTION OF THE INVENTION

Figure 1:
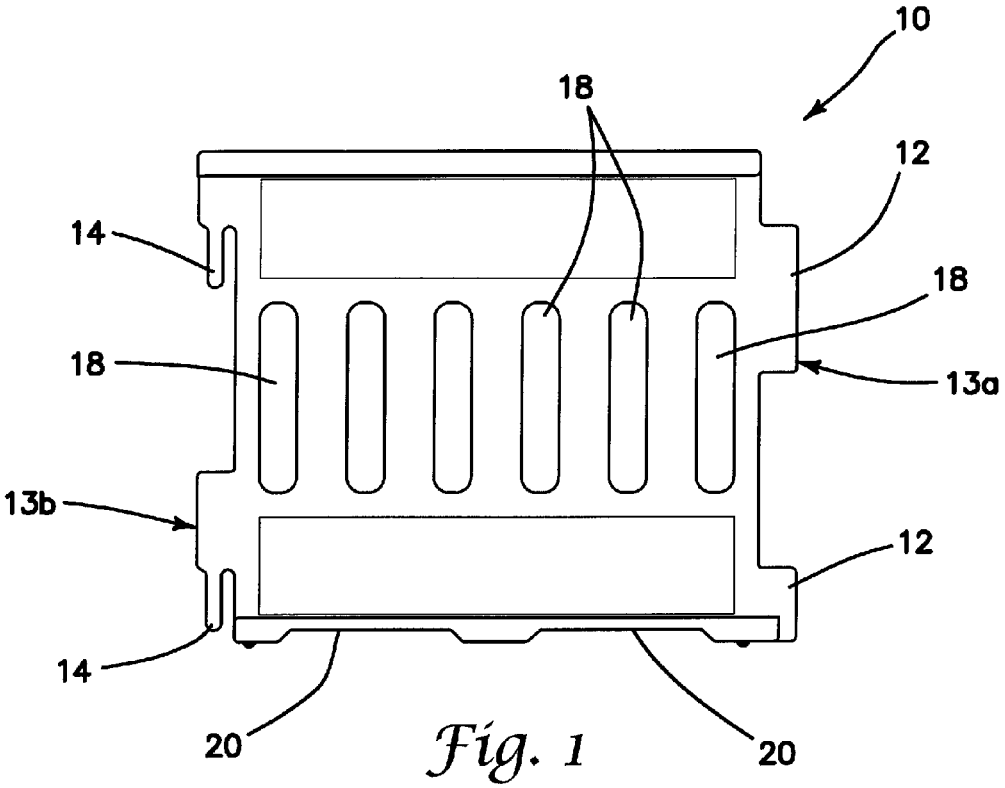
FIG. 1 is a front elevation of one embodiment of the present invention.

Referring now more particularly to the drawings, there is shown in FIG. 1 a pedestrian barricade segment 10 constructed in accordance with the principles of the present invention, and designed to be ADA-compliant. The barricade segment 10 is constructed to be modular, attachable to similar segments on one or both sides thereof, in order to form a desired barricade configuration. Hinge apertures 12 formed on one vertical side 13*a* of the barrier segment 10 are engageable with hinge pins 14 formed on the other vertical side 13*b* of the barrier segment 10 to secure multiple segments together. Advantageously, when the pins 14 are inserted into and engaged with the hinge apertures 12, the respective engaged segments may be pivoted relative to one another, about the hinges created by the engagement, to construct a barricade which is shaped and configured as desired.

Figure 2:
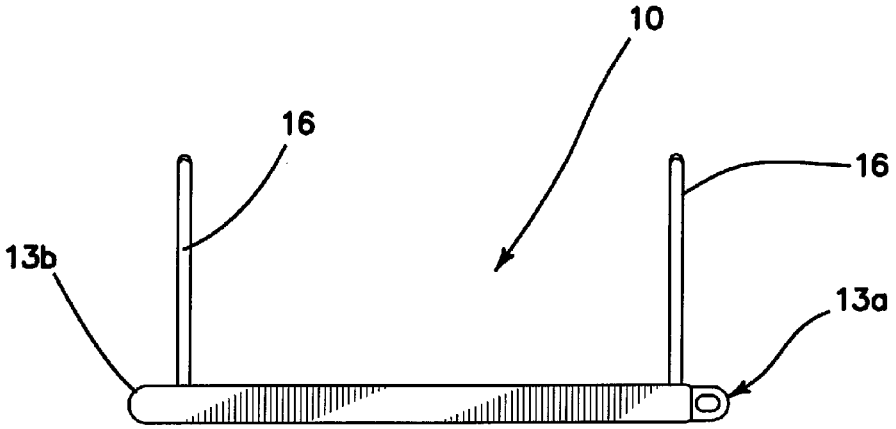
FIG. 2 is a top view of the embodiment of FIG. 1.
Figure 3:
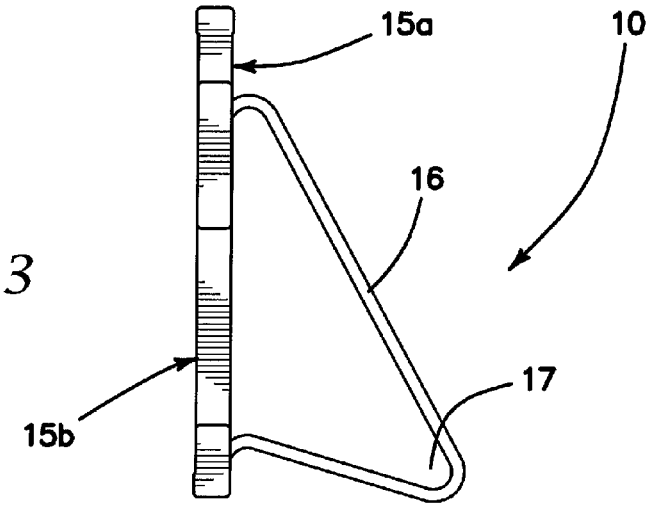
FIG. 3 is a side view of the embodiment of FIG. 1.

Additionally, A-shaped tubular legs 16 are pivotally attached to a rear face 15*a* of each segment 10, which may be folded into alignment and engagement with the barrier segment 10 for transport and storage, or folded outwardly, as shown in FIGS. 2 and 3, in order to support the barrier segment in place. Opposing the rear face 15*a* is a front face 15*b* of the barricade segment 10. When folded outwardly, sandbags may be deployed within the region 17 to assist in anchoring the barrier segment 10 in place. In one embodiment, the panel or segment 10 is blow molded of a suitable plastic material, in a double-walled configuration, with recessed panels for reflective sheeting, and a series of windows 18, which comprise through apertures. The purpose of the windows 18 is to increase the strength of the panel, reduce wind resistance of the panel, provide a view portal for service animals to see and smell potential hazards to the person they are assisting, and to reduce overall segment weight. Pockets are molded in the panel 10, on the rear face 15*a*, for receiving the legs 16 when in the folded configuration. Gaps 20 are molded into the bottom of the panel 10 to permit water to flow beneath the barrier segment and to sometimes allow the panel to sit on uneven ground. A light shelf (not shown) is molded into the barrier segment for securement and to prevent rotation of a barricade light, and molded protrusions with opposing recesses are molded into each panel to form stacking lugs for convenient stacking of multiple segments 10.

The inventive barricade system is designed to be temporary and readily constructed on site by available maintenance or construction laborers. A significant advantage of the system 10 is its versatility, and its ability to be used in a wide variety of circumstances.

Figure 4:
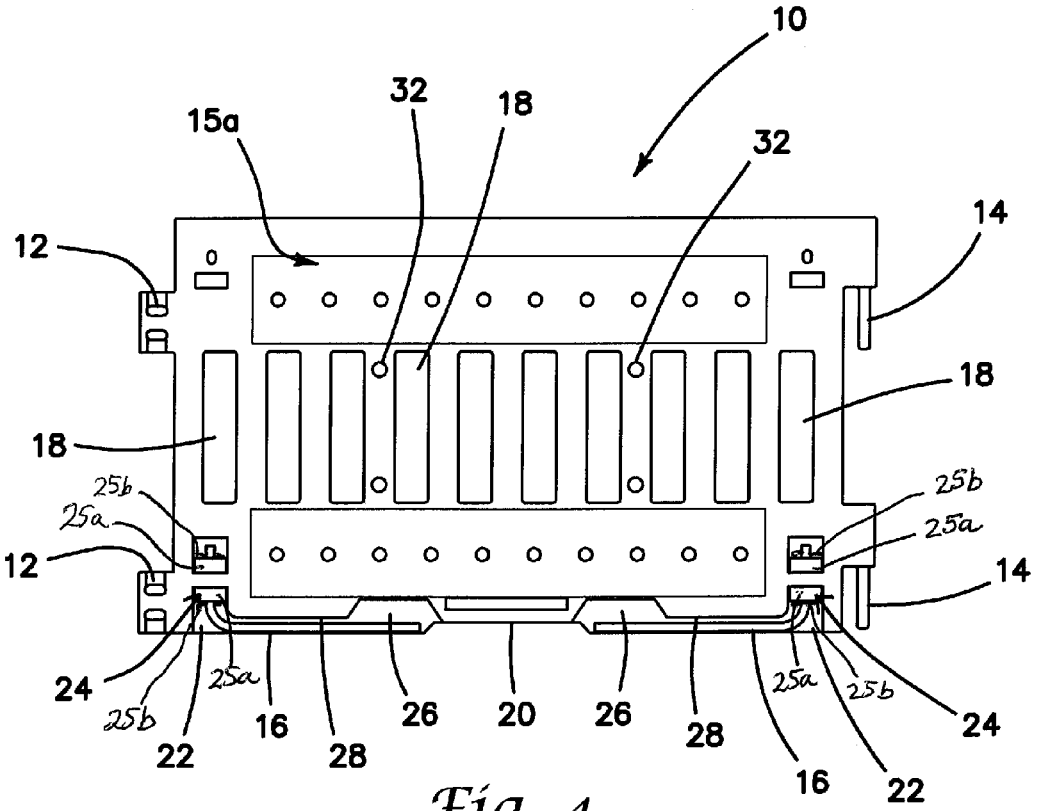
FIG. 4 is a rear elevation of a modified embodiment of the present invention.
Figure 7:
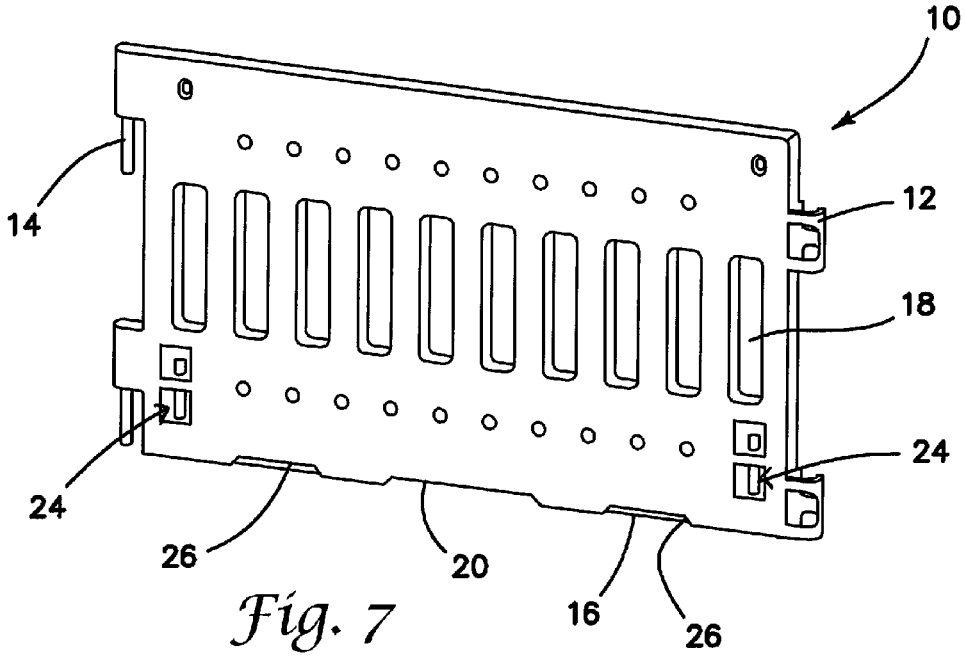
FIG. 7 is an isometric view of the front side of the embodiment of FIG. 4.

FIGS. 4-8 illustrate a second innovative embodiment of the present invention. In this embodiment, wherein like elements are identified by like reference numerals, the legs 16 are not A-shaped, but rather L-shaped, as shown. A recess 22 is molded into the rear face 15*a* of the barrier segment 10, on each end thereof, for receiving the legs 16 when they are folded to their stowed configuration, so that they do not extend beyond the outer surface of the barrier segment, as shown in FIGS. 4-6. This recess 22 extends from the outer end on each side, toward the center of the segment 10, as shown, and also upwardly to also receive a hinge structure 24. This hinge structure 24 permits the leg 16 to be folded between its deployed and stowed configurations, and also creates an innovative deployment feature, as will be discussed below.

The unique leg deployment feature of the present invention involves the molding of two foot pockets 26 in the rear face 15*a* of the segment 10, large enough to comfortably receive the toe end of a user's foot for stepping downwardly on the end of the leg 16 stowed therein, when the leg is in its stowed position. Adjacent to each foot pocket 26, molded in the barrier segment wall, is a locking ramp 28. This ramp 28 comprises molded plastic extending downwardly into the leg recess 22, so that when the leg is stowed, it is secured behind the ramp 28, within the recess 22. When it is desired to deploy the leg 16, rather than having to bend down and use one's hands to release the leg from the recess 22, the user need only insert the toe end of his foot into the foot pocket 26, and step downwardly on the leg 16. This will push the leg downwardly beyond the lower end of the locking ramp 28, so that it is thereby released from the recess and freely swingable outwardly, using one's foot, about the hinge structure 24, to a deployed position (FIG. 6).

The hinge structure 24 comprises wedge blocks 25*a* having upper and lower wave washers 25*b* (see FIG. 5) working in concert with (resting upon) the two flat surfaces of each of the upper and lower wedge blocks (injection molded inserted leg wedges), with flat washers above and below the wave washers which are resting on the normal surfaces of the wedges. Cotter pins secure the elements of the hinge together. The two upper and lower wave washers rest on the normal surfaces of the wedges, are retained and captured by and between the upper and lower cotter pins, and all work in unison on the vertical axis of the leg, preloading the leg within the barricade, and eliminating wobble and slop of the leg during and after deployment or storage.

The injection molded insertable leg wedges provide not only a flat surface to install the wave and flat washer onto the leg at right angles to the pivoting axis of the leg, but further, the injection molded wedges also create a solid pivoting bushing surface, for rotating the leg within the barricade, and provide stiffness to the area where the legs are to be fashioned. This creates a solid pivoting bushing surface, for rotating the leg within the barricade and creating not one, but two plastic bushings above and below the leg's attachment point to the barricade.

Figure 9:
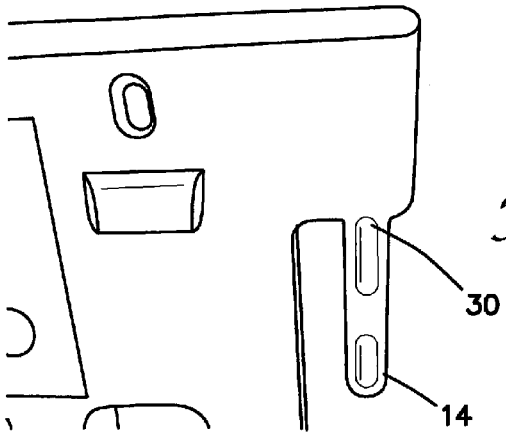
FIG. 9 is a view of a modified embodiment of a barricade segment constructed in accordance with the principles of the present invention, showing particular constructional features surrounding the hinge pin.

From FIG. 9 it can be seen that a recess 30 may be molded into the hinge pins 14 for the purpose of strengthening the pin construction.

Figure 10:
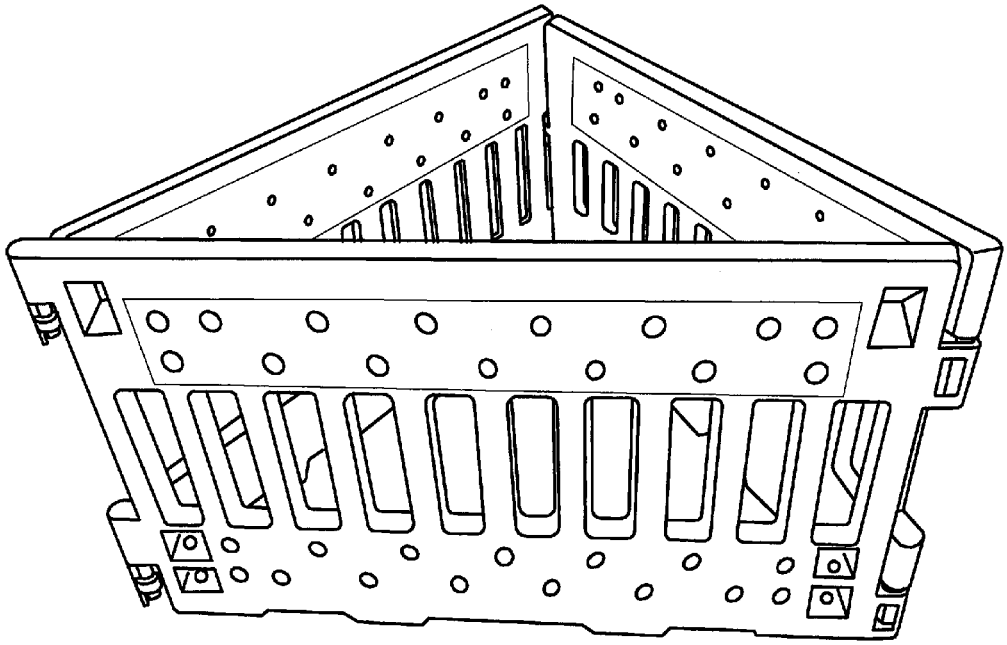
FIG. 10 illustrates that the barricade segments of the present invention may be formed into an enclosure.

FIG. 10 illustrates that the barricade segments may be joined together to form an enclosure. As illustrated, the enclosure is triangular in configuration, though other configurations are available as well. The illustrated configuration is particularly useful for fencing off manhole covers around which utility or construction work is being done, for example, for the protection of workers and also of vehicles or pedestrians. When the barricade segments are joined, there is a range of rotation of over 210 degrees between segments because of the inventive hinge structure 12, 14, which enables the system to adapt to just about any work zone or purpose.

Exemplary barricade segment dimensions, in one particular embodiment, comprise approximately 62 inches in length, 3 inches in width, and 40⅜ inches in height, though these specifications may vary within the scope of the invention.

Advantageously, the unique 24 of the present invention permits the legs 16 to deploy to a variety of orientations, including those rotated at an angle beyond 90 degrees, as shown, for example, in FIG. 6. In the present invention, the deployment angle may be as high as 135 degrees. This flexibility permits the sharing of a single sandbag for ballasting adjacent legs when the barricade segments 10 are joined together, if desired.

Figure 8:
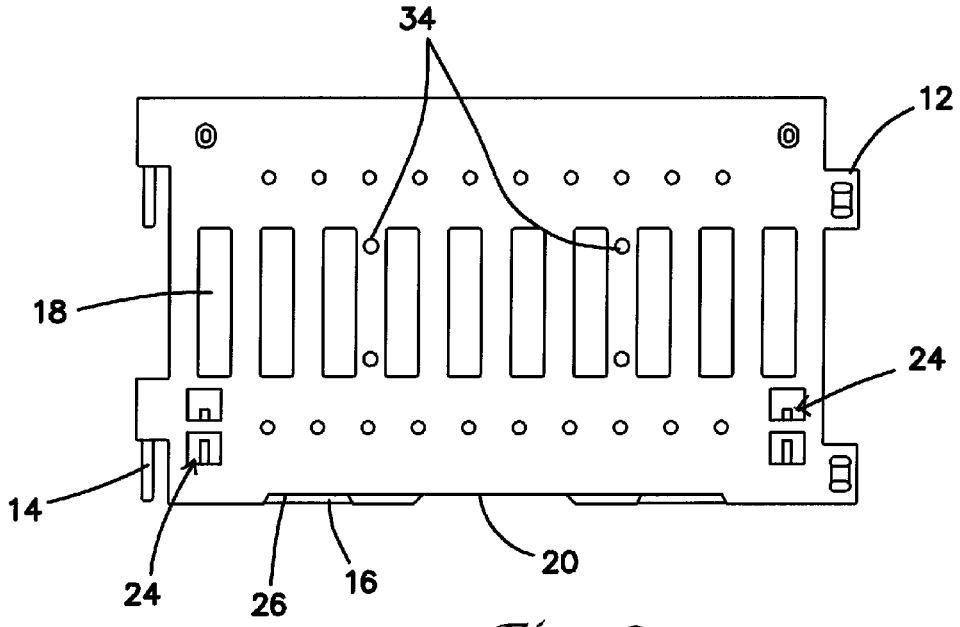
FIG. 8 is a front elevation of the FIG. 4 embodiment.

Stacking lugs 32 may be disposed on the rear face 15*a*, with corresponding stacking recesses 34 disposed in coordinate locations on the front face 15*b* (FIG. 8). Of course, these may be reversed, if desired.

In this second embodiment, as shown in FIGS. 4-8, the male end or hinge pin 14 is concentric in the female end or hinge aperture 12, allowing the wall to rotate freely about the rotating center (axis). The female end 12 is slotted, as shown, to allow for vertical translation in case of uneven or slope grades. Also the female end is constructed of a different design versus the common punched hole. The female end is formed, utilizing the material thickness and curved surfaces to generate a much stronger feature than heretofore known for these types of hinge designs.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A pedestrian barricade segment formed of molded plastic, comprising:

a first vertical side having a hinge member disposed thereon;

a second vertical side having a hinge receptacle disposed thereon, wherein the hinge receptacle is configured to receive the hinge member therein and to engage therewith, to thereby adjoin the segment to an adjacent segment of similar construction;

a front vertical face extending between the first and second vertical sides;

a rear vertical face extending between the first and second vertical sides;

a leg rotatably mounted to a leg hinge structure disposed on the rear vertical face, the leg being rotatable between a stowed orientation wherein the leg lies parallel to the rear vertical face, and a deployed orientation wherein the leg lies at an angle relative to the rear vertical face so that the leg extends rearwardly from the rear vertical face to support the barricade segment in an upright orientation;

a leg recess disposed in said rear vertical face for receiving the leg when it is in its stowed orientation;

a locking ramp comprising molded plastic extending downwardly into the leg recess for securing the leg in said recess behind the locking ramp; and a foot pocket disposed in said rear vertical face which is sufficiently large to receive the toe of a user's foot when the leg is in its stowed orientation, the foot pocket being disposed above said leg recess so that a user may insert their foot into the foot pocket, when the leg is in its stowed orientation, and use the foot to push the leg downwardly, thereby releasing the leg from the locking ramp for deploying the leg.

2. The barricade segment as recited in claim 1, wherein said leg hinge structure comprises a wedge having a flat surface thereon.

3. The barricade segment as recited in claim 2, wherein said leg hinge structure further comprises a wave washer disposed on the flat surface of the wedge, for securing one end of the leg.

4. The barricade segment as recited in claim 3, wherein the leg hinge structure functions to pre-load the leg, the wedge creating a solid pivoting bushing surface for rotating the leg.

5. The barricade segment as recited in claim 4, wherein the leg hinge structure further comprises a second wedge disposed adjacent to said wedge, the second wedge also having a flat surface thereon, the leg hinge structure also comprising a second wave washer disposed on the flat surface of the second wedge.

6. The barricade segment as recited in claim 1, and further comprising a plurality of vertically-oriented windows disposed in said segment and extending along a majority of a total height of the segment.

7. The barricade segment as recited in claim 1, and further comprising a plurality of gaps molded into a bottom edge of the segment, for permitting water flow beneath the segment.

8. The barricade segment as recited in claim 1, wherein the leg is L-shaped.

9. The barricade segment as recited in claim 1, and further comprising a recess molded into said hinge member for strengthening its construction.

* * * * *